US008651888B2

(12) United States Patent
Kurachi

(10) Patent No.: US 8,651,888 B2
(45) Date of Patent: Feb. 18, 2014

(54) ELECTRICAL CONNECTOR

(75) Inventor: Takaki Kurachi, Tokyo (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 13/231,059

(22) Filed: Sep. 13, 2011

(65) Prior Publication Data

US 2013/0065417 A1 Mar. 14, 2013

(51) Int. Cl.
*H01R 13/627* (2006.01)

(52) U.S. Cl.
USPC ..... 439/358; 439/495

(58) Field of Classification Search
USPC ..... 439/357, 358, 495, 492, 493, 499
See application file for complete search history.

(56) References Cited

U.S. PATENT DOCUMENTS 5,951,317 A * 9/1999 Tracy et al. ..... 439/352
7,510,424 B2 * 3/2009 Mundt ..... 439/357

FOREIGN PATENT DOCUMENTS

JP 08-180940 7/1996
JP 2004-165046 A 6/2004

* cited by examiner

*Primary Examiner* — Felix O Figueroa
(74) *Attorney, Agent, or Firm* — Studebaker & Brackett PC

(57) ABSTRACT

An electrical connector including a housing provided thereon with an opening through which a flat circuit device is inserted into the housing, a plurality of conductive contacts arranged on the housing, and a holding member formed in a body on the housing to be operative to hold the flat circuit device inserted in the housing and then to release the flat circuit device from holding by the holding member, wherein the holding member has a movable arm portion extending from an inside surface portion of the housing, and the movable arm portion is provided thereon with an engaging portion operative to engage with the flat circuit device inserted in the housing for holding the same and a releasing portion protruding from the movable arm portion through an aperture provided on the housing toward the outside of the housing and is operative to move the movable arm portion for disengaging the engaging portion from the flat circuit device.

6 Claims, 7 Drawing Sheets

ELECTRICAL CONNECTOR

BACKGROUND OF THE INVENTION

1. Field of the Invention

The present invention relates generally to an electrical connector, and more particularly to an improvement in an electrical connector which has a housing, a plurality of conductive contacts arranged on the housing for coming into contact with connecting terminals provided on a flat circuit device, such as a flexible printed circuit board (hereinafter, referred to as an FPC) or a flexible flat cable assembly (hereinafter, referred to as an FFC) inserted in the housing, and holding means for engaging with the flat circuit device inserted in the housing to hold the same and for disengaging the flat circuit device from holding by the holding meas.

2. Description of Related Art Including Information Disclosed Under 37 CFR 1.97 and 37 CFR 1.98

A flat circuit device, such as a relatively small-sized FPC or FFC, used in electronic apparatus of various kinds is often connected with a main solid circuit board, on which various electrical parts are directly mounted, with an electrical connector which is fixed to and connected electrically with the main solid circuit board. The electrical connector thus used has a plurality of conductive contacts, an end portion of each of which is connected electrically with a conductive circuit pattern portion formed on the main solid circuit board and which are provided for coming into contact with connecting terminals provided on the flat circuit device, and is operative to cause each of the connecting terminals provided on the flat circuit board to be connected electrically through the conductive contact with the conductive circuit pattern portion formed on the main solid circuit board.

A first type of previously proposed electrical connector used for connecting a flat circuit device, such as an FPC, with a main solid circuit board, has a housing made of insulator, which is mounted on the main solid circuit board and has an opening through which at least a part of the flat circuit device is inserted into the housing. On the housing, a plurality of conductive contacts are provided to be arranged along the opening and connected electrically with circuit terminals provided on the main solid circuit board. These conductive contacts are operative to come into contact respectively with a plurality of connecting terminals provided on a flat circuit device when the flat circuit device is inserted into the housing through the opening provided thereon. The previously proposed electrical connector of the first type has also a slider which is provided to be movable to slide in regard to the housing in both of a direction along which the flat circuit device is inserted into the housing through the opening provided thereon and a reverse direction along which the flat circuit device is drawn out of the housing.

The slider is moved to slide for going temporarily away from the housing previous to the insertion of the flat circuit device into the housing through the opening provided thereon and then moved again to slide for returning to the housing after the flat circuit device has been inserted into the housing through the opening provided thereon. Thereby, the slider is operative to press down the flat circuit device to restrain the same under a condition in which the conductive contacts arranged on the housing are put in contact respectively with the connecting terminals provided on the flat circuit device inserted in the housing. With the conductive contacts arranged on the housing and put in contact respectively with the connecting terminals provided on the flat circuit device, the flat circuit device inserted in the housing is connected electrically with the main solid circuit board on which the housing is mounted.

A second type of previously proposed electrical connector used for connecting a flat circuit device with a main solid circuit board has a housing to be mounted on the main solid circuit board and a plurality of conductive contacts in the same manner as the previously proposed electrical connector of the first type mentioned above and in addition an actuator which is provided to be rotatable in regard to the housing, but does not have a slider which is movable to slide in regard to the housing as mentioned above.

In the previously proposed electrical connector of the second type, the actuator is operative to engage with each of the conductive contacts arranged on the housing and to move an operating portion of each of the conductive contacts so that each of the conductive contacts is put in press-contact with a corresponding one of the connecting terminals provided on the flat circuit device inserted in the housing when the actuator is rotated in a first direction in regard to the housing and to allow the operating portion of each of the conductive contacts to move so that each of the conductive contacts is released from the press-contact with the connecting terminal when the actuator is rotated in a second direction opposite to the first direction in regard to the housing, or to push the flat circuit device inserted in the housing so that each of the connecting terminals provided on the flat circuit device is put in press-contact with a corresponding one of the conductive contacts arranged on the housing when the actuator is rotated in a first direction in regard to the housing and to cease to push the flat circuit device so that each of the connecting terminals provided on the flat circuit device is released from the press-contact with the conductive contact when the actuator is rotated in a second direction opposite to the first direction in regard to the housing. With the conductive contacts arranged on the housing and put in press-contact with the connecting terminals provided on the flat circuit device, the flat circuit device is put in electrical connection with the main solid circuit board.

In the above-mentioned previously proposed electrical connector having the slider movable to slide in regard to the housing in both of the direction along which the flat circuit device is inserted into the housing through the opening provided thereon and the reverse direction along which the flat circuit device is drawn out of the housing or the actuator rotatable in regard to the housing, when the flat circuit device is inserted into the housing through the opening provided thereon and the conductive contacts arranged on the housing are put in press-contact with the connecting terminals provided on the flat circuit device so that the flat circuit device is put in electrical connection with the main solid circuit board, it is required to prevent the flat circuit device inserted in the housing from getting out of the housing unwillingly. It is a matter of course that it is necessary for the flat circuit device inserted in the housing to be held stably so as not to get out of the housing unwillingly in order to keep the conductive contacts arranged on the housing properly in a condition of contact with the connecting terminals provided on the flat circuit device.

Accordingly, there has been also proposed previously an electrical connector belonging to the above-described first type having the housing, the conductive contact and the slider movable to slide in regard to the housing, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number HEI08-180940 (hereinafter, referred to as published patent document 1).

In addition, there has been further proposed previously an electrical connector belonging to the above-described second type having the housing, the conductive contact and the actuator rotatable in regard to the housing, which is provided with holding means for engaging with a flat circuit device, such as an FPC or FFC, inserted in the housing so as to hold the same to be prevented from getting out of the housing unwillingly, as shown in, for example, the Japanese patent application published before examination under publication number 2004-165046 (hereinafter, referred to as published patent document 2).

In the electrical connector shown in the published patent document 1, the holding means (a locking claw 12c) is provided in a body on the housing (12) or the holding means (a locking member 30) is provided separately on the housing (22). When the flat circuit device (an FPC 50) is inserted into the housing through an opening provided thereon under a condition in which the slider (14 or 24) has been moved to slide for going temporarily away from the housing, the holding means engages with each of engaging portions (projections (50a and 50b)) provided on the flat circuit device to hold the flat circuit device. After that, when the slider is moved to slide for returning to the housing, the flat circuit device inserted in the housing with connecting terminals provided thereon, with which the conductive contacts (16 or 26) arranged on the housing are put in press-contact respectively, is pressed down to be restrained by the slider and the holding means is also restrained by the slider so as to be prevented from disengaging from each of the engaging portions provided on the flat circuit device.

Thereby, the flat circuit device inserted in the housing is kept in a condition in which the conductive contacts arranged on the housing are put in press-contact respectively with the connecting terminals provided on the flat circuit device and held by the holding means provided in a body or separately on the housing to be put in engagement with the engaging portion of the flat circuit device so as to be prevented from getting out of the housing unwillingly.

In the electrical connector shown in the published patent document 2, a couple of holding means (holding members 13) formed in a body of the housing (10) or a couple of holding means (holding members 51) formed separately on the housing (10) are attached respectively to end portions of the housing aligned in a direction along which the conductive contacts (terminals 30) are arranged. Each of the holding means is provided thereon with a holding portion (13A or 51A) formed in the shape of claw. When the flat circuit device (a flat conductor 40) is inserted into the housing through an opening (11) provided thereon under a condition in which the actuator (a movable member 20) which is provided to be rotatable in regard to the housing takes a position at which the actuator keeps rising from the housing, the holding portion formed in the shape of claw on the holding means is put in engagement with an engaging portion (a recess 42) provided on the flat circuit device to hold the flat circuit device. After that, when the actuator is rotated from the position where the actuator keeps rising from the housing to another position where the actuator keeps lying down on the housing, the flat circuit device inserted in the housing with connecting terminals provided thereon, with which the conductive contacts (16 or 26) arranged on the housing are put in press-contact respectively, is pressed down to be restrained by the actuator.

Thereby, the flat circuit device inserted in the housing is kept in a condition in which the conductive contacts arranged on the housing are put in press-contact respectively with the connecting terminals provided on the flat circuit device and held by the holding means provided in a body or separately on the housing to be put in engagement with the engaging portion of the flat circuit device so as to be prevented from getting out of the housing unwillingly.

In each of the electrical connectors thus proposed previously, which is provided with the housing, the conductive contact, the slider movable to slide in regard to the housing in both of the direction along which the flat circuit device is inserted into the housing through the opening provided thereon and the reverse direction along which the flat circuit device is drawn out of the housing or the actuator rotatable in regard to the housing, and the holding means for engaging with the flat circuit device inserted in the housing to hold the same so that the flat circuit device is prevented from getting out of the housing unwillingly, when the slider is moved to slide for returning to the housing or the actuator is placed at the position where the actuator keeps lying down on the housing under a condition in which the flat circuit device has been inserted in the housing, a portion of the electrical connector in which the holding means is put in engagement with the engaging portion of the flat circuit device is covered by the slider or the actuator so as not to be observed visually from the outside of the housing. Accordingly, it can not be confirmed by visual observation whether the holding means is appropriately put in engagement with the engaging portion of the flat circuit device to hold the flat circuit device or not.

Further, in the electrical connectors proposed previously as described above, any means for releasing the holding means attached to the housing from the engagement with the flat circuit device inserted in the housing after the holding means is put in the engagement with the flat circuit device to hold the same is not provided. When the flat circuit device inserted in the housing and once held by the holding means attached to the housing is subjected to getting away from the housing, it is necessary for drawing the flat circuit device out of the housing to exert undesirable coercive force on the flat circuit device and the holding means. This results in a fear that operation efficiency is deteriorated and at least one of the flat circuit device, the holding means and the housing is undesirably deformed or damaged.

BRIEF SUMMARY OF THE INVENTION

Accordingly, it is an object of the present invention to provide an electrical connector used for connecting a flat circuit device, such as an FPC or FFC, with a solid circuit board, which comprises a housing provided with an opening through which a flat circuit device is inserted into the housing, a plurality of conductive contacts provided to be arranged on the housing, and a holding member for holding the flat circuit device inserted in the housing through the opening provided thereon, and which avoids the aforementioned problems or disadvantages encountered with the prior art.

Another object of the present invention is to provide an electrical connector used for connecting a flat circuit device, such as an FPC or FFC, with a solid circuit board, which comprises a housing provided with an opening through which a flat circuit device is inserted into the housing, a plurality of conductive contacts provided to be arranged on the housing, and a holding member for holding the flat circuit device inserted in the housing through the opening provided thereon, and in which the flat circuit device inserted in the housing can be easily and surely put in holding by the holding member to be prevented from getting out of the housing unwillingly.

A further object of the present invention is to provide an electrical connector used for connecting a flat circuit device, such as an FPC or FFC, with a solid circuit board, which comprises a housing provided with an opening through which a flat circuit device is inserted into the housing, a plurality of conductive contacts provided to be arranged on the housing, and a holding member for holding the flat circuit device inserted in the housing through the opening provided thereon, and in which the flat circuit device inserted in the housing can be easily released from holding by the holding member without exerting undesirable coercive force on the flat circuit device and the holding member.

A still further object of the present invention is to provide an electrical connector used for connecting a flat circuit device, such as an FPC or FFC, with a solid circuit board, which comprises a housing provided with an opening through which a flat circuit device is inserted into the housing, a plurality of conductive contacts provided to be arranged on the housing, and a holding member for holding the flat circuit device inserted in the housing through the opening provided thereon, and with which a situation wherein the holding member is appropriately put in engagement with the flat circuit device inserted in the housing to hold the same can be confirmed by visual observation from the outside of the housing.

According to the present invention, as claimed in any one of claims, there is provided an electrical connector, which comprises a housing made of insulator to be mounted on a solid circuit board and provided thereon with an opening through which a flat circuit device, such as an FPC or FFC, is inserted into the housing, a plurality of conductive contacts arranged on the housing to be electrically connected respectively with circuit terminals provided on the solid circuit board and positioned to correspond respectively to connecting terminals provided on the flat circuit device inserted in the housing through the opening provided thereon, and a holding member formed in a body on the housing to be movable and operative to hold the flat circuit device inserted in the housing through the opening provided thereon and then to release the flat circuit device from holding by the holding member, wherein the holding member has a movable arm portion extending from an inside surface portion of the housing, and the movable arm portion is provided thereon with an engaging portion operative to engage with the flat circuit device inserted in the housing so as to hold the same and a releasing portion protruding from the movable arm portion through an aperture provided on the housing toward the outside of the housing and is operative to move the movable arm portion for disengaging the engaging portion from the flat circuit device so that the flat circuit device is released from holding by the engaging portion when the releasing portion is manipulated to be shifted in position.

Especially, in a first example of electronic connector according to the present invention, the movable arm portion of the holding member extends from the inside surface portion of the housing toward an end portion of the housing on which the opening is provided, the engaging portion is formed at a free end of the movable arm portion, and the releasing portion is formed at an intermediate part of the movable arm portion.

Further, in a second example of electronic connector according to the present invention, the aperture provided on the housing has a portion thereof through which the flat circuit device held by the engaging portion of the holding member can be observed visually from the outside of the housing.

In addition, in a third example of electronic connector according to the present invention, a stepped depression adjacent to the aperture is provided on the housing and a top end of the releasing portion protruding from the movable arm portion through the aperture toward the outside of the housing is positioned so as not to project beyond a portion of an external surface portion of the housing surrounding the stepped depression but to project beyond the stepped depression when the releasing portion is not manipulated.

In the electrical connector thus constituted in accordance with the present invention, when the flat circuit device is inserted into the housing through the opening provided thereon, each of the conductive contacts provided to be arranged on the housing comes into contact with a corresponding one of the connecting terminals provided on the flat circuit device inserted in the housing and the holding member formed in a body on the housing engages with the flat circuit device inserted in the housing to hold the same. As a result, the flat circuit device inserted in the housing is prevented from getting out of the housing unwillingly.

Then, when the holding member is manipulated in a predetermined manner under a condition wherein the flat circuit device inserted in the housing is held by the holding member, the holding member is operative to release the flat circuit device from the holding by the holding member in the housing. As a result, the flat circuit device inserted in the housing is put in a condition to be able to get out of the housing.

The holding member thus provided in the electrical connector according to the invention has the movable arm portion extending from the inside surface portion of the housing. On the movable arm portion, the engaging portion and the releasing portion are provided. The engaging portion is operative to engage with the flat circuit device inserted in the housing to hold the same. The releasing portion is formed to protrude from the movable arm portion through the aperture provided on the housing toward the outside of the housing and is operative to move the movable arm portion for disengaging the engaging portion from the flat circuit device when the releasing portion is manipulated to be shifted in position.

In the holding member employed, for example, in the first example of electrical connector as mentioned above, the movable arm portion extends from the inside surface portion of the housing toward the end portion of the housing on which the opening is provided, the engaging portion is formed at the free end of the movable arm portion, and the releasing portion is formed at the intermediate part of the movable arm portion.

Further, the aperture provided on the housing employed, for example, in the second example of electrical connector as mentioned above, has the portion thereof through which the flat circuit device held by the engaging portion of the holding member can be observed visually from the outside of the housing.

In addition, the housing employed, for example, in the third example of electrical connector as mentioned above, is provided thereon with the stepped depression adjacent to the aperture and the top end of the releasing portion is positioned so as not to project beyond the portion of the external surface portion of the housing surrounding the stepped depression but to project beyond the stepped depression when the releasing portion is not manipulated.

With the electrical connector thus constituted in accordance with the present invention, as described above, the engaging portion of the holding member formed in a body on the housing engages with the flat circuit device to hold the same so that the flat circuit device is prevented from getting out of the housing unwillingly when the flat circuit device is inserted in the housing through the opening provided thereon, and then the movable arm portion of the holding member is moved to disengage the engaging portion from the flat circuit device so that the flat circuit device is released from the holding by the engaging portion of the holding member when the releasing portion of the holding member is manipulated to be shifted in its position. As a result, the flat circuit device inserted in the housing can be easily and surely held by the holding member so as to be prevented from getting out of the housing unwillingly with a relatively simplified constitution in which a relatively small number of constitutive parts are contained, and then the flat circuit device inserted in the housing can be released from holding by the holding member so as to be able to get out of the housing without exerting undesirable coercive force on the flat circuit device and the holding member.

Especially, in the first example of electrical connector according to the present invention, since the movable arm portion of the holding member extends from the inside surface portion of the housing toward the end portion of the housing on which the opening is provided with the engaging portion formed at the free end thereof and the releasing portion formed at the intermediate part thereof, the engaging portion provided on the movable arm portion of the holding member can be surely and smoothly put in the engagement with the flat circuit device to hold the same when the flat circuit device is inserted in the housing through the opening provided thereon and then the movable arm portion of the holding member can be efficiently and surely moved to release the engaging portion of the holding member from the engagement with the flat circuit device when the releasing portion of the holding member is manipulated to be shifted in its position.

Further, with the second example of electrical connector according to the present invention, a situation wherein the flat circuit device inserted in the housing is appropriately held by the engaging portion of the holding member can be observed visually from the outside of the housing through the portion of the aperture provided on the housing.

Besides, in the third example of electrical connector according to the present invention, since the top end of the releasing portion of the holding member is positioned so as not to project beyond the portion of the external surface portion of the housing surrounding the stepped depression adjacent to the aperture through which the releasing portion protrudes toward the outside of the housing but to project beyond the stepped depression when the releasing portion is not manipulated, it is not required for manipulating the releasing portion to have any specific space around the housing and the releasing portion does not interfere with various parts placed around the housing.

The above, and other objects, features and advantages of the present invention will become apparent from the following detailed description taken in conjunction with the accompanying drawings.

DETAILED DESCRIPTION OF THE INVENTION

Figure 1:
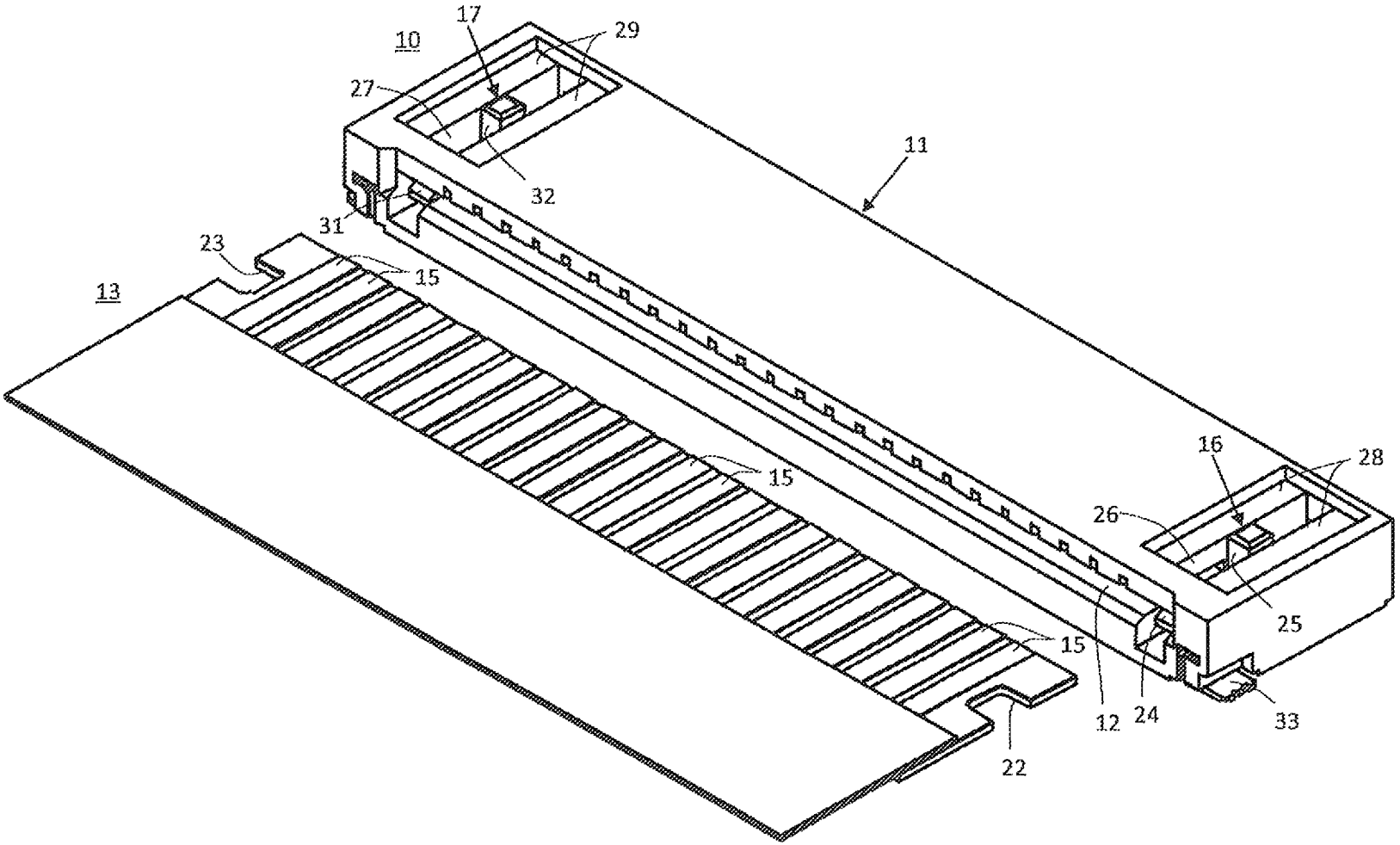
FIG. 1 is a schematic front, top and right side perspective view showing an embodiment of electrical connector according to the present invention, together with an FPC which is to be inserted into the housing of the embodiment.
Figure 2:
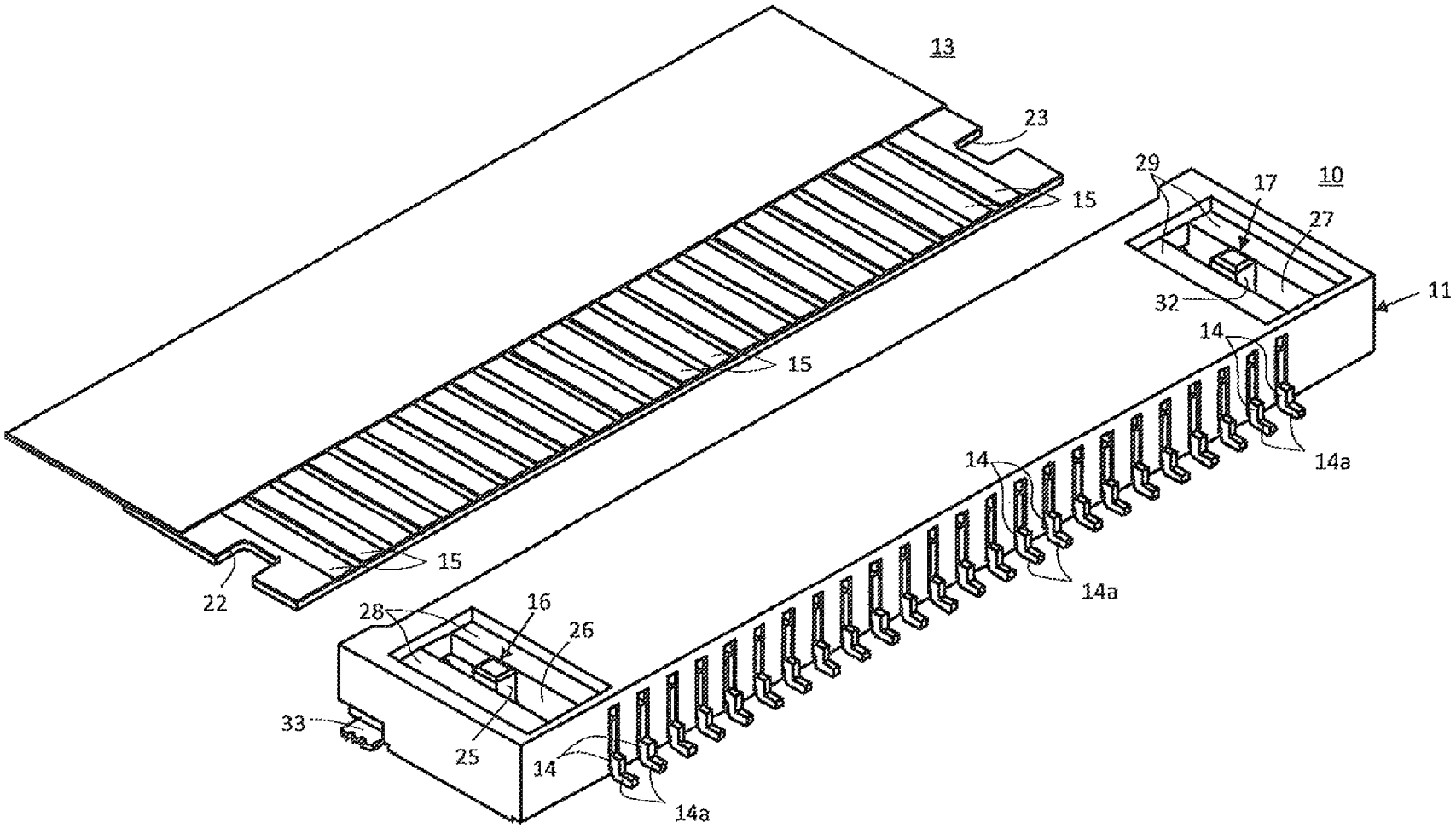
FIG. 2 is a schematic rear, top and left side perspective view showing the embodiment shown in FIG. 1, together with the FPC which is to be inserted into the housing of the embodiment.
Figure 3:
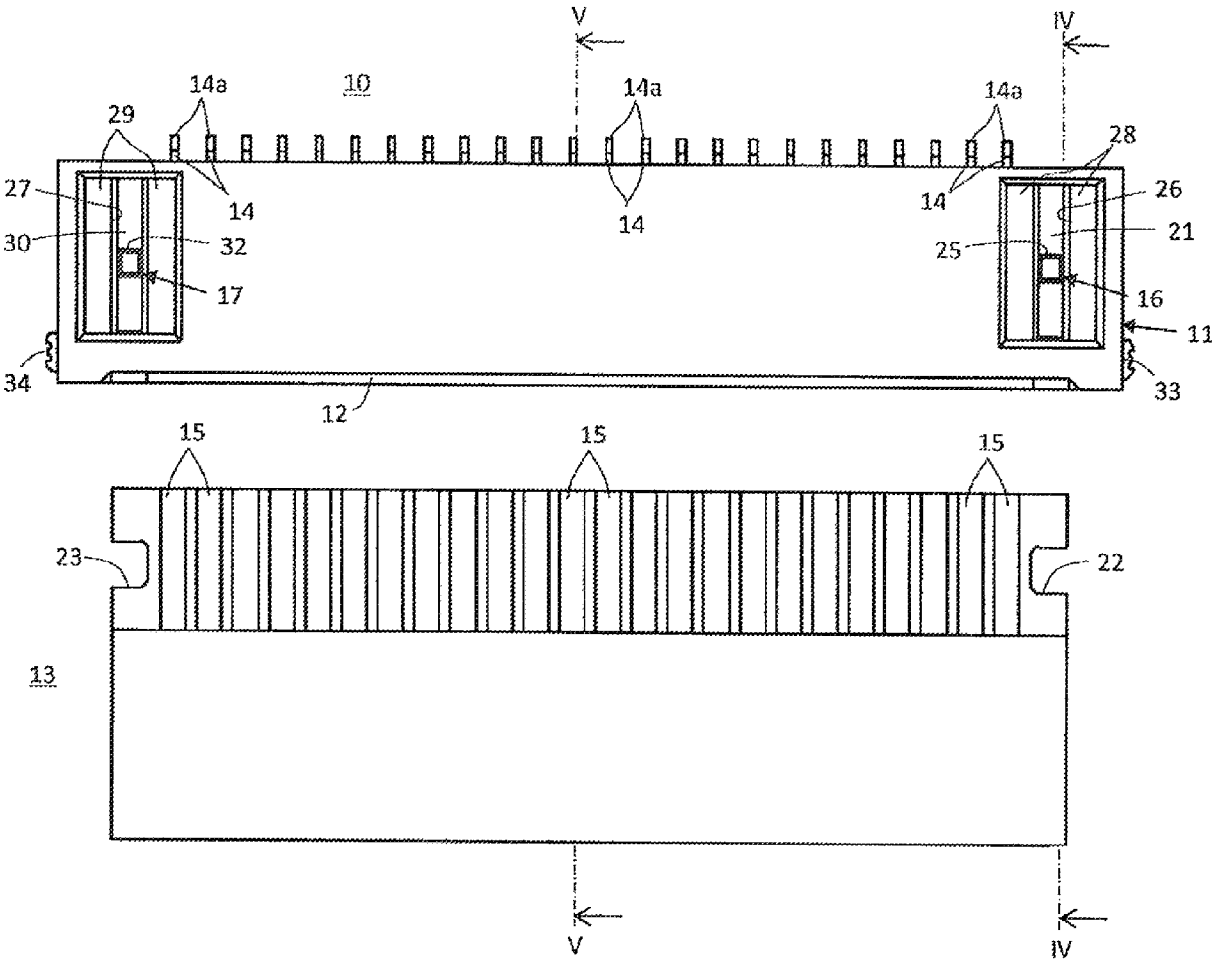
FIG. 3 is a schematic plan view showing the embodiment shown in FIG. 1, together with the FPC which is to be inserted into the housing of the embodiment.

Each of FIG. 1 which is a schematic front, top and right side perspective view, FIG. 2 which is a schematic rear, top and left side perspective view and FIG. 3 which is a plan view, shows an embodiment of electrical connector according to the present invention, together with an FPC which is provided to be inserted into the embodiment.

Referring to FIGS. 1 to 3, an electrical connector 10, which constitutes the embodiment of electrical connector according to the present invention, has a housing 11 made of insulator, such as plastics or the like. The housing 11 is provided on a front end portion thereof with an opening 12 through which a flat circuit device, such as an FPC, is inserted into the housing 11. In the housing 11, a room extending from the opening 12 is formed for accommodating the flat circuit device inserted through the opening 12 into the housing 11.

The housing 11 has a first end surface portion which is an outer surface portion of a lower or bottom end of the housing 11 shown in FIGS. 1 to 3 and a second end surface portion which is an outer surface portion of an upper or top end of the housing 11 shown in FIGS. 1 to 3 and opposite to the first end surface portion. Hereinafter, the first end surface portion is referred to as a lower external surface portion and the second end surface portion is referred to as an upper external surface portion. When the electrical connector 10 is put in practical use, the housing 11 is mounted on a solid circuit board (not shown in the drawings) with the lower external surface portion facing the solid circuit board and the upper external surface portion positioned to be open to a space on the solid circuit board, and, for example, an FPC 13 constituting the flat circuit device is inserted into the housing 11 through the opening 12 provided thereon.

A plurality of conductive contacts 14, each of which is made of resilient conductive material, are provided on the housing 11 to be arranged in a longitudinal direction of the housing 11. That is, a direction along which the conductive contacts 14 are arranged is the longitudinal direction of the housing 11. Each of the conductive contacts 14 constitutes, for example, a signal contact operative to come into contact with a signal connecting terminal provided on the FPC 13. It is also possible for the conductive contacts 14 to include, in addition to the signal contacts, one or more ground contacts operative to come into contact with a ground connecting portion provided on the FPC 13.

Further, each of the conductive contacts 14 has a connecting terminal portion 14*a* projecting from a rear end portion of the housing 11 to the outside of the housing 11, as shown in FIG. 2. The connecting terminal portion 14*a* of the conductive contact 14 is connected electrically by means of soldering with one of circuit terminals provided on the solid circuit board on which the housing 11 is mounted. A main portion of each of the conductive contacts 14 is, for example, thrust into the housing 11 from the rear end portion thereof to be fixed in the housing 11 when the electrical connector 10 is assembled.

When the FPC 13 is inserted in the housing 11 through the opening 12 provided thereon, the conductive contacts 14 are come into contact respectively with a plurality of connecting terminals 15 arranged on the FPC 13, so that the connecting terminals 15 arranged on the FPC 13 inserted in the housing 11 are electrically connected through the conductive contacts 14 respectively with the circuit terminals provided on the solid circuit board on which the housing 11 is mounted.

A couple of holding members 16 and 17, each of which is formed in a body on the housing 11 to be movable, are provided respectively to both end portions in the longitudinal direction of the housing 11. That is, each of the holding members 16 and 17 formed in a body on the housing 11 is made of insulator, such as plastics or the like, and the holding members 16 and 17 are provided on the housing 11 to be opposite to each other with the opening 12 between in the longitudinal direction of the housing 11.

Figure 4:
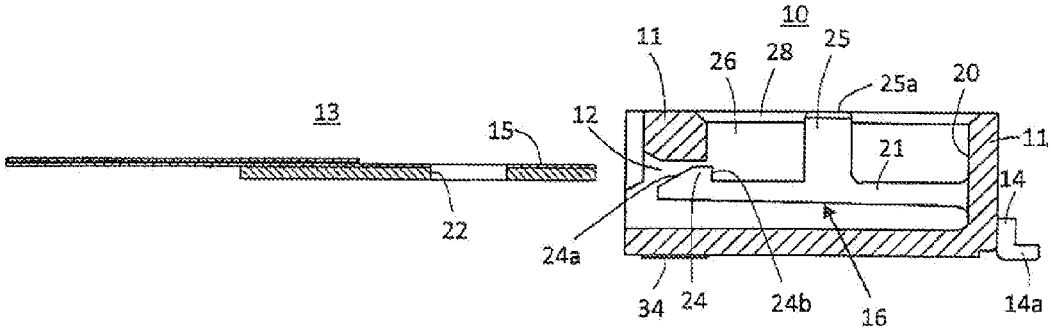
FIG. 4 is a schematic cross sectional view taken along line IV-IV on FIG. 3.

As shown in FIG. 4 which is a schematic cross sectional view taken along line IV-IV on FIG. 3, the holding member 16 has a movable arm portion 21 extending from an inside surface portion 20 of the rear end portion of the housing 11 toward the front end portion of the housing 11 on which the opening 12 is provided. The movable arm portion 21 is provided thereon with an engaging portion 24 which is formed at a free end of the movable arm portion 21 for engaging with an engaging edged recess 22 provided on the FPC 13 inserted in the housing 11 so as to hold the FPC 13 and a releasing portion 25 which is formed at an intermediate part of the movable arm portion 21 to be manipulated for releasing the FPC 13 from holding by the engaging portion 24. The movable arm portion 21 is operative to swing resiliently, together with the engaging portion 24 and the releasing portion 25, with a fulcrum on a part of the inside surface portion 20 of the rear end portion of the housing 11 at which the movable arm portion 21 is connected with the inside surface portion 20.

The engaging portion 24 has a slanted end plane 24*a* formed thereon to ascends gradually in a direction along which the FPC 13 is inserted into the housing 11 through the opening 12 provided thereon and an engaging end plane 24*b* set to face toward the releasing portion 25. The engaging end plane 24*b* is operative to engage directly with the engaging edged recess 22 provided on the FPC 13 inserted in the housing 11. When the FPC 13 is inserted into the housing 11 through the opening 12, a top end portion of the FPC 13 comes into contact with the slanted end plane 24*a* formed on the engaging portion 24 and the slanted end plane 24*a* is operative to guide the top end portion of the FPC 13 to ride across the engaging portion 24.

The releasing portion 25 protrudes from the movable arm portion 21 through an aperture 26 provided on the upper external surface portion of the housing 11 toward the outside of the housing 11. The releasing portion 25 thus provided is operative to move the movable arm portion 21 toward the lower external surface portion of the housing 11 for disengaging the engaging portion 24 from the engaging edged recess 22 provided on the FPC 13 so that the FPC 13 is released from the holding by the engaging portion 24 when the releasing portion 25 is manipulated, for example, to be pushed down in a direction from the upped external surface portion of the housing 11 to the lower external surface portion of the housing 11.

On the upper external surface portion of the housing 11, a stepped depression 28 is formed to be adjacent to the aperture 26. A top end 25*a* of the releasing portion 25 protruding through the aperture 26 toward the outside of the housing 11 is positioned so as not to project beyond a portion of the upper external surface portion of the housing 11 surrounding the stepped depression 28 but to project beyond the stepped depression 28 when the releasing portion 25 is not manipulated. Thereby, it is not required for manipulating the releasing portion 25 to have any specific space around the housing 11 and the releasing portion 25 does not interfere with various parts placed around the housing 11.

Although detailed illustrations are omitted, the holding member 17 has also a movable arm portion 30 corresponding to the movable arm portion 21 of the holding member 16, which extends from the inside surface portion 20 of the rear end portion of the housing 11 toward the front end portion of the housing 11 on which the opening 12 is provided, as shown in FIG. 3. The movable arm portion 30 is provided thereon with an engaging portion 31 shown in FIG. 1, which is formed at a free end of the movable arm portion 30 for engaging with an engaging edged recess 23 provided on the FPC 13 inserted in the housing 11 so as to hold the FPC 13, and a releasing portion 32 which is formed at an intermediate part of the movable arm portion 30 to be manipulated for releasing the FPC 13 from holding by the engaging portion 31. The movable arm portion 30 is also operative to swing resiliently, together with the engaging portion 31 and the releasing portion 32, with a fulcrum on a part of the inside surface portion 20 of the rear end portion of the housing 11 at which the movable arm portion 30 is connected with the inside surface portion 20.

Figure 6:
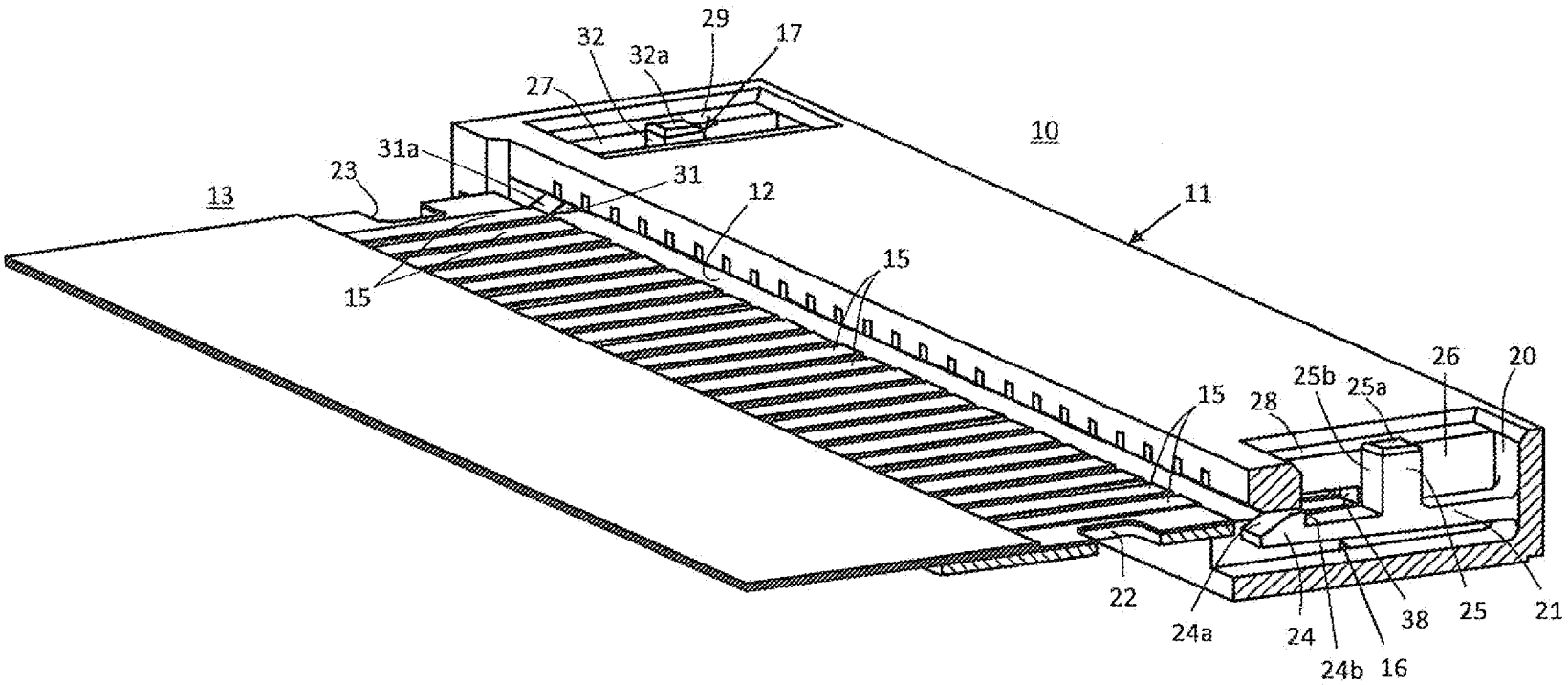
FIG. 6 is a schematic partial perspective view including partial cross sections and showing the embodiment shown in FIG. 1, together with the FPC which is to be inserted into the housing of the embodiment.

The engaging portion 31 has a slanted end plane 31*a* formed thereon to ascends gradually in the direction along which the FPC 13 is inserted into the housing 11 through the opening 12 provided thereon, as shown in FIG. 6, and an engaging end plane set to face toward the releasing portion 32, in the same manner as the engaging portion 24 of the holding member 16. The engaging end plane formed on the engaging portion 31 is operative to engage directly with the engaging edged recess 23 provided on the FPC 13 inserted in the housing 11. When the FPC 13 is inserted into the housing 11 through the opening 12, the top end portion of the FPC 13 comes into contact with the slanted end plane 31*a* formed on the engaging portion 31 and the slanted end plane 31*a* is operative to guide the top end portion of the FPC 13 to ride across the engaging portion 31.

The releasing portion 32 protrudes from the movable arm portion 30 through an aperture 27 provided on the upper external surface portion of the housing 11 toward the outside of the housing 11. The releasing portion 32 thus provided is operative to move the movable arm portion 30 toward the lower external surface portion of the housing 11 for disengaging the engaging portion 31 from the engaging edged recess 23 provided on the FPC 13 so that the FPC 13 is released from the holding by the engaging portion 31 when the releasing portion 32 is manipulated, for example, to be pushed down in the direction from the upped external surface portion of the housing 11 to the lower external surface portion of the housing 11.

On the upper external surface portion of the housing 11, a stepped depression 29 is also formed to be adjacent to the aperture 27. A top end 32*a* of the releasing portion 32 protruding through the aperture 27 toward the outside of the housing 11 is positioned so as not to project beyond a portion of the upper external surface portion of the housing 11 surrounding the stepped depression 29 but to project beyond the stepped depression 29 when the releasing portion 32 is not manipulated. Thereby, it is not required for manipulating the releasing portion 32 to have any specific space around the housing 11 and the releasing portion 32 does not interfere with various parts placed around the housing 11.

As shown in FIG. 3, the aperture 26 provided on the upper external surface portion of the housing 11 has a portion thereof through which the FPC 13 held by the engaging portion 24 provided on the movable arm portion 21 of the holding member 16 can be observed visually from the outside of the housing 11 and the aperture 27 provided on the upper external surface portion of the housing 11 has a portion thereof through which the FPC 13 held by the engaging portion 31 provided on the movable arm portion 30 of the holding member 17 can be observed visually from the outside of the housing 11.

The electrical connector 10 is further provided with a couple of board connecting portions 33 and 34 projecting from the lower external surface portion of the housing 11 to the outside of the housing 11 respectively at both end portions of the housing 11 in the longitudinal direction thereof. Each of the board connecting portions 33 and 34 is made of conductive metallic material and soldered to a conductive portion provided on the solid circuit board on which the housing 11 is mounted with the lower external surface portion thereof facing the solid circuit board so as to contribute to firm mounting of the housing 11 on the solid circuit board.

Figure 5:
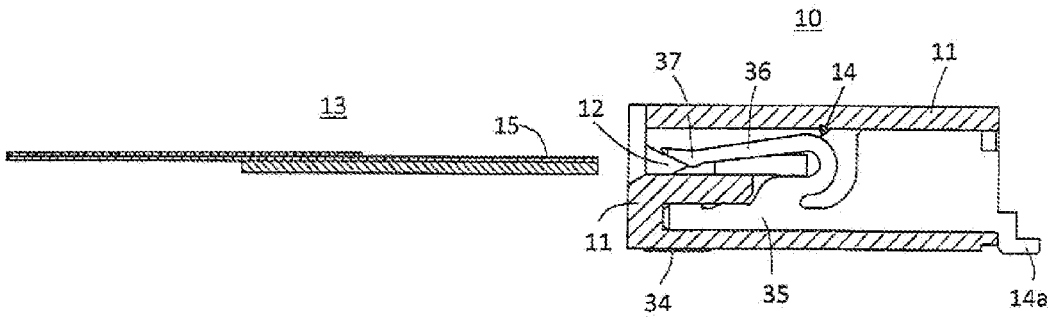
FIG. 5 is a schematic cross sectional view taken along line V-V on FIG. 3.

As shown in FIG. 5 which is a schematic cross sectional view taken along line V-V on FIG. 3, each of the conductive contacts 14 arranged on the housing 11 has a fixed portion 35 operative to be fixed to the housing 11 and a curved arm portion 36 extending from the fixed portion 35. The connecting terminal portion 14*a* extends from the fixed portion 35 to the outside of the housing 11 and a contacting point portion 37 is provided at a top end of the curved arm portion 36.

When the FPC 13 is inserted into the housing 11 of the electrical connector 10 through the opening 12 provided on the housing 11 under a condition wherein the housing 11 is mounted on the solid circuit board, the top end portion of the FPC 13 is positioned to be opposite to the opening 12 provided on the front end portion of the housing 11, shown in FIGS. 1 to 5, so that the connecting terminals 15 provided on the FPC 13 are so positioned as to correspond respectively to the conductive contacts 14 arranged on the housing 11 and the engaging edged recesses 22 and 23 provided on the FPC 13 are so positioned as to correspond respectively to the engaging portion 24 provided on the movable arm portion 21 of the holding member 16 and the engaging portion 31 provided on the movable arm portion 30 of the holding member 17.

After that, the FPC 13 positioned as shown in FIGS. 1 to 5 is inserted into the housing 11 through the opening 12 provided thereon, as shown in FIG. 6 which is a schematic partial perspective view including partial cross sections. In the housing 11, an inside of a part of the stepped depression 28 is provided thereon with an engaging plane 38 with which the top end portion of the FPC 13 inserted in the housing 11 to be held by the engaging portion 24 of the holding member 16 comes into contact. The engaging plane 38 and a side face 25*b* of the releasing portion 25 of the holding member 16 facing to the engaging portion 24 are substantially put on a common plan. Similarly, an inside of a part of the stepped depression 29 is provided thereon with an engaging plane with which the top end portion of the FPC 13 inserted in the housing 11 to be held by the engaging portion 31 of the holding member 17 comes into contact. This engaging plane and a side face of the releasing portion 32 of the holding member 17 facing to the engaging portion 31 are substantially put on a common plan.

On that occasion, first the top end portion of the FPC 13 comes into contact with both of the slanted end plane 24*a* of the engaging portion 24 provided on the movable arm portion 21 of the holding member 16 and the slanted end plane 31*a* of the engaging portion 31 provided on the movable arm portion 30 of the holding member 17 in the housing 11.

Then, the top end portion of the FPC 13 is guided by the slanted end plane 24*a* of the engaging portion 24 and the slanted end plane 31*a* of the engaging portion 31 to ride across the engaging portions 24 and 31. At this time, the movable arm portion 21 of the holding member 16 is temporarily put in resilient deformation to shift in its position so as to approach the lower external surface portion of the housing 11 and the movable arm portion 30 of the holding member 17 is also temporarily put in resilient deformation to shift in its position so as to approach the lower external surface portion of the housing 11. Then, the movable arm portion 21 of the holding member 16 is restored to its condition prior to the resilient deformation by means of its own restoring resilient force and the movable arm portion 30 of the holding member 17 is also restored to its condition prior to the resilient deformation by means of its own restoring resilient force. Thereby, as shown in FIG. 7, the engaging end plane 24*b* formed on the engaging portion 24 of the holding member 16 is put in direct engagement with the engaging edged recess 22 provided on the FPC 13 to hold the FPC 13 and the engaging end plane formed on the engaging portion 31 of the holding member 17 is put in direct engagement with the engaging edged recess 23 provided on the FPC 13 to hold the FPC 13.

When the engaging end plane 24*b* formed on the engaging portion 24 of the holding member 16 and the engaging end plane formed on the engaging portion 31 of the holding member 17 are put in engagement respectively with the engaging edged recesses 22 and 23 provided on the FPC 13, the FPC 13 has been completely inserted into the housing 11 to be placed at a predetermined appropriate position in the housing 11 with the top end portion thereof in contact with the engaging plane 38 provided on the inside of the part of the stepped depression 28 and the engaging plane provided on the inside of the part of the stepped depression 29. That is, the FPC 13 inserted in the housing 11 is appropriately held by both of the engaging portion 24 of the holding member 16 and the engaging portion 31 of the holding member 17 so as to be prevented from getting out of the housing 11 unwillingly. As a result, This results in that the FPC 13 is automatically held by the engaging portion 24 provided on the movable arm portion 21 of the holding member 16 and the engaging portion 31 provided on the movable arm portion 30 of the holding member 17 so as to be put in a condition to be prevented from getting out of the housing 11 unwillingly only by means of being appropriately inserted into the housing 11.

The top end portion of the FPC 13 which has been in contact with the engaging plane 38 provided on the inside of the part of the stepped depression 28 and the engaging plane provided on the inside of the part of the stepped depression 29 has reached each of the side face 25*b* of the releasing portion 25 of the holding member 16 and the side face of the releasing portion 32 of the holding member 17. The top end portion of the FPC 13 thus positioned can be observed visually through the part of each of the apertures 26 and 27 provided on the upper external surface portion of the housing 11 from the outside of the housing 11. Accordingly, a situation wherein the FPC 13 is placed at the predetermined appropriate position in the housing 11 to be held appropriately by both of the engaging portion 24 provided on the movable arm portion 21 of the holding member 16 and the engaging portion 31 provided on the movable arm portion 30 of the holding member 17 can be confirmed by means of observing visually the top end portion of the FPC 13 positioned as mentioned above through the part of each of the apertures 26 and 27 from the outside of the housing 11.

Figure 7:
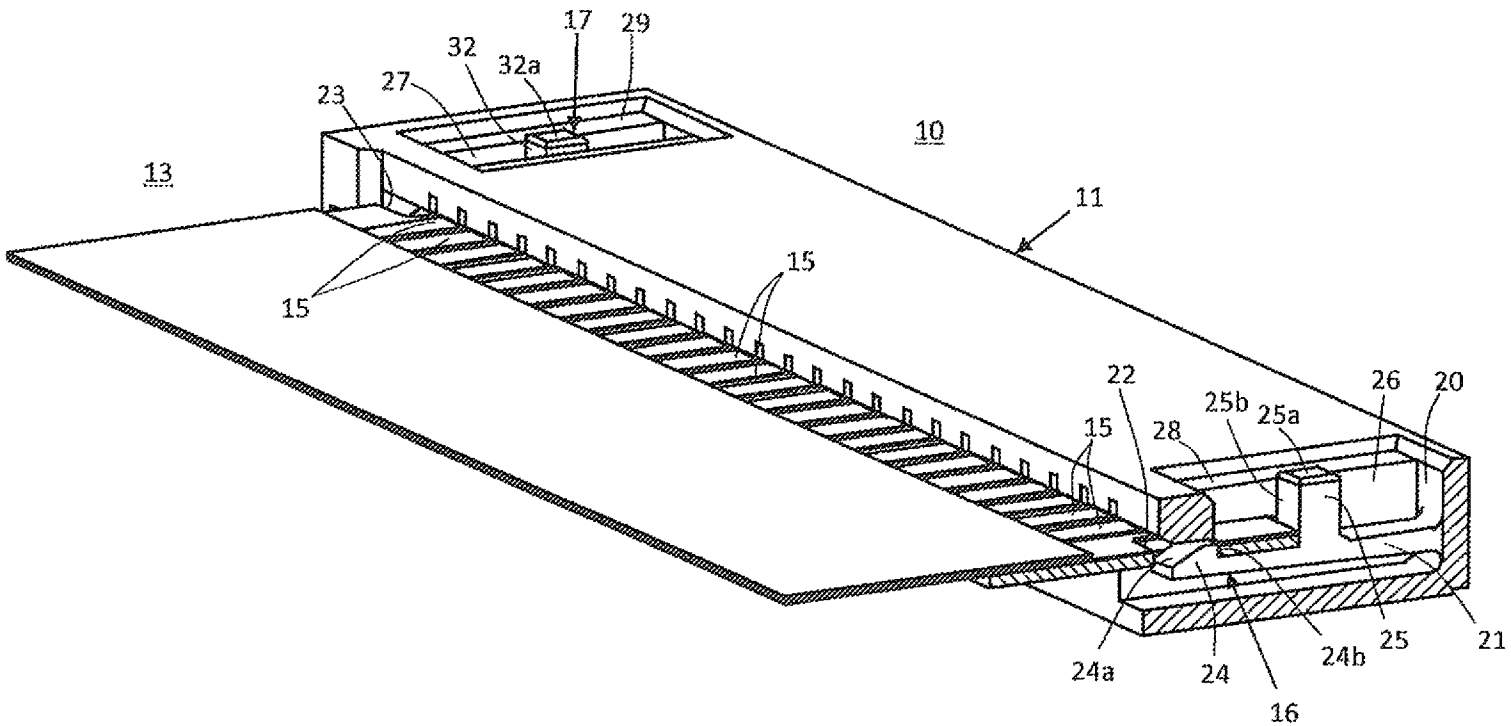
FIG. 7 is a schematic partial perspective view including partial cross sections and showing the embodiment shown in FIG. 1, together with the FPC which has been inserted in the housing of the embodiment and held by a holding member employed in the embodiment.

On that occasion, the top end 25*a* of the releasing portion 25 provided on the movable arm portion 21 of the holding member 16 is positioned to face to the outside of the housing 11 through the aperture 26 provided on the upper external surface portion of the housing 11, as shown in FIG. 7, and the top end 32*a* of the releasing portion 32 provided on the movable arm portion 30 of the holding member 17 is positioned to face to the outside of the housing 11 through the aperture 27 provided on the upper external surface portion of the housing 11. Therefore, the situation wherein the FPC 13 is placed at the predetermined appropriate position in the housing 11 to be held appropriately by both of the engaging portion 24 provided on the movable arm portion 21 of the holding member 16 and the engaging portion 31 provided on the movable arm portion 30 of the holding member 17 can be confirmed also by means of visual observation of or finger touch to the top end 25*a* of the releasing portion 25 and the top end 32*a* of the releasing portion 32.

Under a condition wherein the FPC 13 inserted in the housing 11 takes up the predetermined appropriate position in the housing 11 in the manner described above, the contacting point portion 37 provided at the top end of the curved arm portion 36 of each of the conductive contacts 14 arranged on the housing 11 comes into resilient press-contact with one of the connecting terminals 15 provided on the FPC 13, so that the conductive contacts 14 are electrically connected respectively with the connecting terminals 15 provided on the FPC 13. As a result, the connecting terminals 15 provided on the FPC 13 inserted in the housing 11 are electrically connected through the conductive contacts 14 with the circuit terminals provided on the solid circuit board on which the housing 11 is mounted. Such a condition that the connecting terminals 15 provided on the FPC 13 are electrically connected through the conductive contacts 14 with the circuit terminals provided on the solid circuit board as mentioned above is automatically obtained when the FPC 13 is appropriately inserted into the housing 11.

Figure 8:
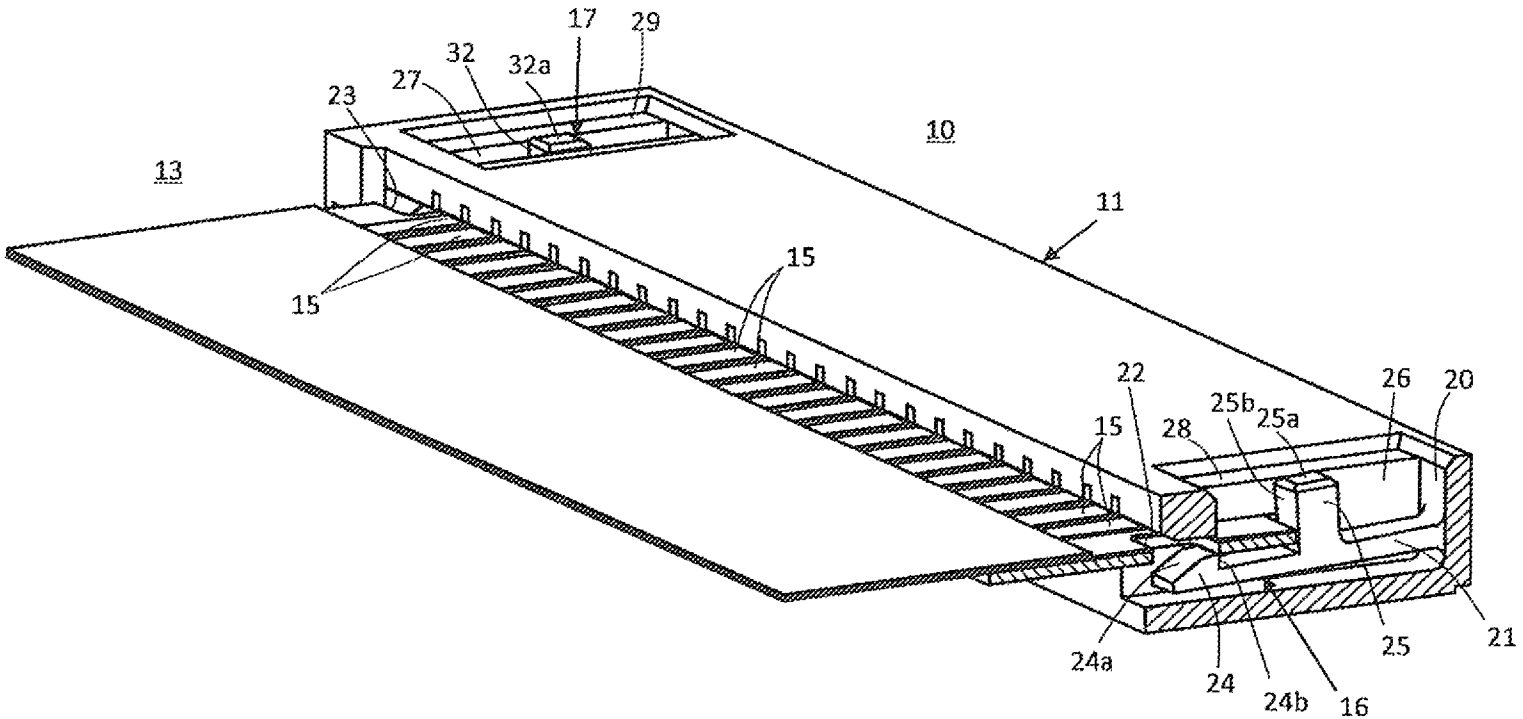
FIG. 8 is a schematic partial perspective view including partial cross sections and showing the embodiment shown in FIG. 1, together with the FPC which is released from holding by the holding member employed in the embodiment.

After that, as shown in FIG. 8, when the top end 25*a* of the releasing portion 25 provided on the movable arm portion 21 of the holding member 16, which is positioned to face to the outside of the housing 11 through the aperture 26 provided on the upper external surface portion of the housing 11, is manipulated to be pushed into the housing 11, the movable arm portion 21 is resiliently deformed to shift in its position so as to cause the engaging portion 24 provided thereon to approach the lower external surface portion of the housing 11. As a result, the engaging portion 24 provided on the movable arm portion 21 of the holding member 16 is disengaged from the engaging edged recess 22 provided on the FPC 13 so that the FPC 13 is released from holding by the engaging portion 24. That is, the releasing portion 25 provided on the movable arm portion 21 of the holding member 16 is operative to move the movable arm portion 21 for causing the engaging portion 24 provided on the movable arm portion 21 to release the FPC 13 from the holding thereby when the top end 25*a* of the releasing portion 25 facing to the outside of the housing 11 through the aperture 26 provided on the upper external surface portion of the housing 11 is manipulated to be pushed into the housing 11.

Similarly, when the top end 32*a* of the releasing portion 32 provided on the movable arm portion 30 of the holding member 17, which is positioned to face to the outside of the housing 11 through the aperture 27 provided on the upper external surface portion of the housing 11, is manipulated to be pushed into the housing 11, the movable arm portion 30 is resiliently deformed to shift in its position so as to cause the engaging portion 31 provided thereon to approach the lower external surface portion of the housing 11. As a result, the engaging portion 31 provided on the movable arm portion 30 of the holding member 17 is disengaged from the engaging edged recess 23 provided on the FPC 13 so that the FPC 13 is released from holding by the engaging portion 31. That is, the releasing portion 32 provided on the movable arm portion 30 of the holding member 17 is operative to move the movable arm portion 30 for causing the engaging portion 31 provided on the movable arm portion 30 to release the FPC 13 from the holding thereby when the top end 32*a* of the releasing portion 32 facing to the outside of the housing 11 through the aperture 27 provided on the upper external surface portion of the housing 11 is manipulated to be pushed into the housing 11.

With the engaging portion 24 provided on the movable arm portion 21 of the holding member 16 and the engaging portion 31 provided on the movable arm portion 30 of the holding member 17 each caused to release the FPC 13 from the holding thereby as mentioned above, the FPC 13 inserted in the housing 11 is put in a condition to be able to get out of the housing 11 appropriately. When the FPC 13 is drawn out of the housing 11, each of the movable arm portion 21 of the holding member 16 and the movable arm portion 30 of the holding member 17 is restored to its condition prior to the resilient deformation by means of its own restoring resilient force.

Although the FPC 13 described above is provided with the engaging edged recesses 22 and 23, it is also possible for the FPC 13 to have a couple of engaging holes in place of the engaging edged recesses 22 and 23. In the case where the engaging holes are provided on the FPC 13 in place of the engaging edged recesses 22 and 23, the FPC 13 inserted in the housing 11 is also held by both of the engaging portion 24 provided on the movable arm portion 21 of the holding member 16 and the engaging portion 31 provided on the movable arm portion 30 of the holding member 17 in the same manner as mentioned above.

Further, although the FPC 13 is inserted in the housing 11 with the connecting terminals 15 provided thereon to face toward the upper external surface portion of the housing 11 and the conductive contacts 14 arranged on the housing 11 come into resilient contact respectively with the connecting terminals 15 provided on the FPC 13 from the side of the upper external surface portion of the housing 11, in the electrical connector 10 described above, it is also possible to modify the electrical connector 10 in such a manner that the FPC 13 is inserted in the housing 11 with the connecting terminals 15 provided thereon to face toward the lower external surface portion of the housing 11 and the conductive contacts 14 arranged on the housing 11 come into resilient contact respectively with the connecting terminals 15 provided on the FPC 13 from the side of the lower external surface portion of the housing 11. It is further possible for the conductive contacts 14 to constitute first and second groups so that the conductive contacts 14 belonging to the first group to come into resilient contact with connecting terminals provided on an FPC inserted in the housing 11 from the side of the upper external surface portion of the housing 11 and the conductive contacts 14 belonging to the second group to come into resilient contact with connecting terminals provided on the FPC inserted in the housing 11 from the side of the lower external surface portion of the housing 11, are arranged alternately on the housing 11.

With the electrical connector 10 constituting the embodiment of electrical connector according to the present invention as described above, when the FPC 13 is inserted into the housing 11 thorough the opening 12 provided thereon, such a condition that the connecting terminals 15 provided on the FPC 13 inserted in the housing 11 are electrically connected through the conductive contacts 14 arranged on the housing 11 with the circuit terminals provided on the solid circuit board on which the housing 11 is mounted and the FPC 13 inserted in the housing 11 is appropriately held by both of the engaging portion 24 provided on the movable arm portion 21 of the holding member 16 and the engaging portion 31 provided on the movable arm portion 30 of the holding member 17 so as to be prevented from getting out of the housing 11 unwillingly, can be obtained automatically.

Further, in the electrical connector 10, the engaging portions 24 and 31 of the holding members 16 and 17 each formed in a body on the housing 11 are operative to engage respectively with the engaging edged recesses 22 and 23 provided on the FPC 13 to hold the same so that the FPC 13 is prevented from getting out of the housing 11 unwillingly when the FPC 13 is inserted in the housing 11 through the opening 12 provided thereon, and then the movable arm portions 21 and 30 of the holding members 16 and 17 are moved to disengage the engaging portions 24 and 31 respectively from the engaging edged recesses 22 and 23 provided on the FPC 13 so that the FPC 13 is released from the holding by both of the engaging portions 24 and 31 of the holding member 16 and 17 when the releasing portions 25 and 32 of the holding members 16 and 17 are manipulated to be shifted in position. As a result, the FPC 13 inserted in the housing 11 can be easily and surely held by both of the holding members 16 and 17 so as to be prevented from getting out of the housing 11 unwillingly with a relatively simplified constitution in which a relatively small number of constitutive parts are contained, and then the FPC 13 inserted in the housing 11 can be released from the holding by both of the holding members 16 and 17 so as to be able to get out of the housing 11 without exerting undesirable coercive force on the FPC 13 and the holding members 16 and 17.

In addition, in the electrical connector 10, since the movable arm portion 21 of the holding member 16 extends from the inside surface portion 20 of the rear end portion of the housing 11 toward the front end portion of the housing 11 on which the opening 12 is provided so as to have the engaging portion 24 formed at the free end thereof and the releasing portion 25 formed at the intermediate part thereof, and the movable arm portion 30 of the holding member 17 extends from the inside surface portion 20 of the rear end portion of the housing 11 toward the front end portion of the housing 11 on which the opening 12 is provided so as to have the engaging portion 31 formed at the free end thereof and the releasing portion 32 formed at the intermediate part thereof, the engaging portions 24 and 31 provided respectively on the movable arm portions 21 and 30 of the holding members 16 and 17 can be surely and smoothly put in the engagement with the FPC 13 to hold the same when the FPC 13 is inserted in the housing 11 through the opening 12 provided thereon and then the movable arm portions 21 and 30 of the holding members 16 and 17 can be efficiently and surely moved to release the engaging portions 24 and 31 of the holding members 16 and 17 from the engagement with the FPC 13 when the releasing portions 25 and 32 of the holding members 16 and 17 are manipulated to be shifted in position.

The invention claimed is:

1. An electrical connector comprising:

a housing made of insulator to be mounted on a solid circuit board and provided thereon with an opening through which a flat circuit device is inserted into the housing, a plurality of conductive contacts arranged on the housing to be electrically connected respectively with circuit terminals provided on the solid circuit board and positioned to correspond respectively to connecting terminals provided on the flat circuit device inserted in the housing through the opening provided thereon, and a holding member formed in a body on the housing to have a movable arm portion which extends from an inside surface portion of the housing to be provided thereon with an engaging portion operative to engage with the flat circuit device inserted in the housing so as to hold the same and a releasing portion protruding from the movable arm portion through an aperture provided on the housing toward the outside of the housing and is operative to move the engaging portion from the flat circuit device so that the flat circuit device is released from holding by the engaging portion when the releasing portion is manipulated to be shifted in position, wherein the housing is provided on an inside thereof with an engaging plane with which a top end portion of the flat circuit device inserted in the housing to be held by the engaging portion of the holding member comes into contact, and the engaging plane and a plane defined by a side face of the releasing portion facing to the engaging portion are co-planar.

2. An electrical connector according to claim 1, wherein the movable arm portion of the holding member extends from the inside surface portion of the housing toward an end portion of the housing on which the opening is provided, the engaging portion is formed at a free end of the movable arm portion, and the releasing portion is formed at an intermediate part of the movable arm portion.

3. An electrical connector according to claim 2, wherein the engaging portion has a slanted end plane formed thereon to ascend gradually in a direction along which the flat circuit device is inserted into the housing through the opening provided thereon and an engaging end plane set to face toward the releasing portion for engaging with the flat circuit device inserted in the housing.

4. An electrical connector according to claim 2, wherein the aperture provided on the housing has a portion thereof through which the top end portion of the flat circuit device having been in contact with the engaging plane and reached the side face of the releasing portion facing to the engaging portion can be observed visually from the outside of the housing.

5. An electrical connector according to claim 1, wherein a stepped depression adjacent to the aperture is provided on the housing and a top end of the releasing portion protruding from the movable arm portion through the aperture toward the outside of the housing is positioned so as not to project beyond a portion of an external surface portion of the housing surrounding the stepped depression but to project beyond the stepped depression when the releasing portion is not manipulated.

6. An electrical connector according to claim 1, wherein a couple of holding members are provided respectively at both end portions of the housing aligned in a direction along which the conductive contacts are arranged.

* * * * *